US006165058A

United States Patent [19]

Zuniga et al.

[11] Patent Number: 6,165,058

[45] Date of Patent: Dec. 26, 2000

[54] CARRIER HEAD FOR CHEMICAL MECHANICAL POLISHING

[75] Inventors: Steven Zuniga, Soquel; Hung Chen, San Jose, both of Calif.

[73] Assignee: Applied Materials, Inc., Santa Clara, Calif.

[21] Appl. No.: 09/207,700

[22] Filed: Dec. 9, 1998

[51] Int. Cl.[7] ..... B24B 37/04

[52] U.S. Cl. ..... 451/287; 451/288; 451/398

[58] Field of Search ..... 451/286, 287, 451/288, 289, 398

[56] References Cited

U.S. PATENT DOCUMENTS

| | | | |
|---|---|---|---|
| 4,918,869 | 4/1990 | Kitta | 51/131.1 |
| 5,193,316 | 3/1993 | Olmstead | 51/281 |
| 5,205,082 | 4/1993 | Shendon et al. | 451/41 |
| 5,423,716 | 6/1995 | Strasbaugh | 451/388 |
| 5,449,316 | 9/1995 | Strasbaugh | 451/289 |
| 5,584,751 | 12/1996 | Kobayashi et al. | 451/288 |
| 5,624,299 | 4/1997 | Shendon | 451/28 |
| 5,625,299 | 4/1997 | Shendon | 451/28 |
| 5,643,053 | 7/1997 | Shendon | 451/28 |
| 5,643,061 | 7/1997 | Jackson et al. | 451/281 |
| 5,709,593 | 1/1998 | Guthrie et al. | 451/287 |
| 5,759,918 | 6/1998 | Hoshizaki et al. | 438/692 |
| 5,803,799 | 9/1998 | Volodarsky et al. | 451/288 |
| 5,820,448 | 10/1998 | Shamoulian et al. | 451/287 |
| 5,851,140 | 12/1998 | Barns et al. | 451/288 |
| 5,879,220 | 3/1999 | Hasegawa et al. | 451/288 |
| 5,897,426 | 4/1999 | Somekh | 451/41 |
| 5,957,751 | 9/1999 | Govzman et al. | 451/8 |
| 5,964,653 | 10/1999 | Perlov et al. | 451/288 |

FOREIGN PATENT DOCUMENTS

| | | |
|---|---|---|
| 0841123 | 5/1998 | European Pat. Off. . |
| 2243263 | 9/1990 | Japan . |
| WO 96/36459 | 11/1996 | WIPO . |
| WO 99/07516 | 2/1999 | WIPO . |

*Primary Examiner*—Joseph J. Hail, III
*Assistant Examiner*—William Hong
*Attorney, Agent, or Firm*—Fish & Richardson

[57] ABSTRACT

A carrier head for a chemical mechanical polishing apparatus includes a base, a flexible membrane extending beneath the base to provide a mounting surface for a substrate, and a retaining ring surrounding the mounting surface. An edge portion of the flexible membrane extends around an outer surface of a support structure. An outer surface of the support structure is tapered to reduce binding between the flexible membrane and the retaining ring. Alternately, there may be a relatively wide gap between the support structure and the retaining ring, or a sidewall portion of the flexible membrane may be reinforced.

22 Claims, 3 Drawing Sheets

104
110
116
170a
174
172
114
$W_1$
170
176
170b
178
180
118
192
194
196
182
100

104
110
116
174
172
114'
184
170'
176
$W_2$
178'
180'
118'
192
112'
194
196
100'

104
110
116
174
172
114"
$W_3$
170"
176
178
180"
118"
192
112"
194
196
186
100'

CARRIER HEAD FOR CHEMICAL MECHANICAL POLISHING

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate.

A polishing slurry, including at least one chemically-reactive agent, and abrasive particles, if a standard pad is used, is supplied to the surface of the polishing pad. The chemical and mechanical interaction between the polishing pad, slurry and substrate results in polishing.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge effect", i.e., the tendency of the substrate edge to be polished at a different rate than the substrate center. The edge effect typically results in overpolishing (the removal of too much material from the substrate) at the substrate perimeter, e.g. the outermost five to ten millimeters of a 200 mm wafer.

Another problem, particularly in the polishing of a substrate using a carrier head with a flexible membrane, is binding of the flexible membrane to the retaining ring. Specifically, the edge of the flexible membrane may "stick" to the retaining ring, rather than moving inward (if the chamber is evacuated) or outward (if the chamber is pressurized). This creates an uneven pressure distribution on the substrate which can results in non-uniform polishing or difficultly in chucking the substrate to the carrier head.

SUMMARY

In general, in one aspect, the invention is directed to a carrier head for a chemical mechanical polishing apparatus.

The carrier head includes a base, a flexible membrane extending beneath the base to provide a mounting surface for a substrate, and a retaining ring surrounding the mounting surface. An edge portion of the flexible membrane extends around an outer surface of a support structure, and the outer surface of the support structure is tapered so as to reduce binding between the flexible membrane and the retaining ring.

Implementations of the invention may include one or more of the following features. The support structure may include a support ring and a clamp, and the edge portion of the flexible membrane may be secured between the clamp and the support ring. The radius of the support structure may be greater at its bottom than at its top. The outer surface of the support structure may include a sloped section, e.g., with an off-vertical angle between about 5° and 45°, and a substantially vertical section.

In another aspect, the invention is directed to a carrier head for a chemical mechanical polishing apparatus. The carrier head has a base, a support structure movably connected to the base, a flexible membrane extending beneath the base to provide a mounting surface for a substrate, and a retaining ring surrounding the mounting surface. An edge portion of the flexible membrane extends around an outer surface of the support structure, and the outer surface of the support structure is tapered to limit contact between the edge portion of the flexible membrane and an inner surface of the retaining ring to reduce binding therebetween.

In another aspect, the invention is directed to a carrier head for a chemical mechanical polishing apparatus. The carrier head includes a base, a flexible membrane extending beneath the base to provide a mounting surface for a substrate, and a retaining ring surrounding the mounting surface. An edge portion of the flexible membrane extends around an outer surface of a support structure, and a gap is formed between the flexible membrane and an inner surface of the retaining ring that is sufficiently wide to reduce binding therebetween.

The width of the gap may be between about 0.5 and 2.0 mm, e.g., about 1.25 mm.

In another aspect, the invention is directed to a carrier head for a chemical mechanical polishing apparatus. The carrier head includes a base, a flexible membrane extending beneath the base to provide a mounting surface for a substrate, and a retaining ring surrounding the mounting surface. An edge portion of the flexible membrane extends around an outer surface of a support structure. The flexible membrane also includes a sidewall portion which is more rigid than the lower surface of the flexible membrane to reduce binding between the retaining ring and the flexible membrane.

Implementations of the invention may include one or more of the following features. The sidewall portion of the flexible membrane may be reinforced, e.g., with cloth, metal or plastic. The flexible membrane may be formed substantially of rubber. Reinforcing fibers or a rigid ring may be molded into the sidewall portion.

Advantages of the invention may include the following. Binding of the flexible membrane to the retaining ring is reduced, thereby improving the finish and flatness of the substrate.

Other advantages and features of the invention will be apparent from the following description, including the drawings and claims.

BRIEF DESCRIPTION OF THE DRAWINGS

Like reference numbers are designated in the various drawings to indicate like elements. A primed reference number indicates that an element has a modified function, operation or structure.

DETAILED DESCRIPTION

Figure 1:
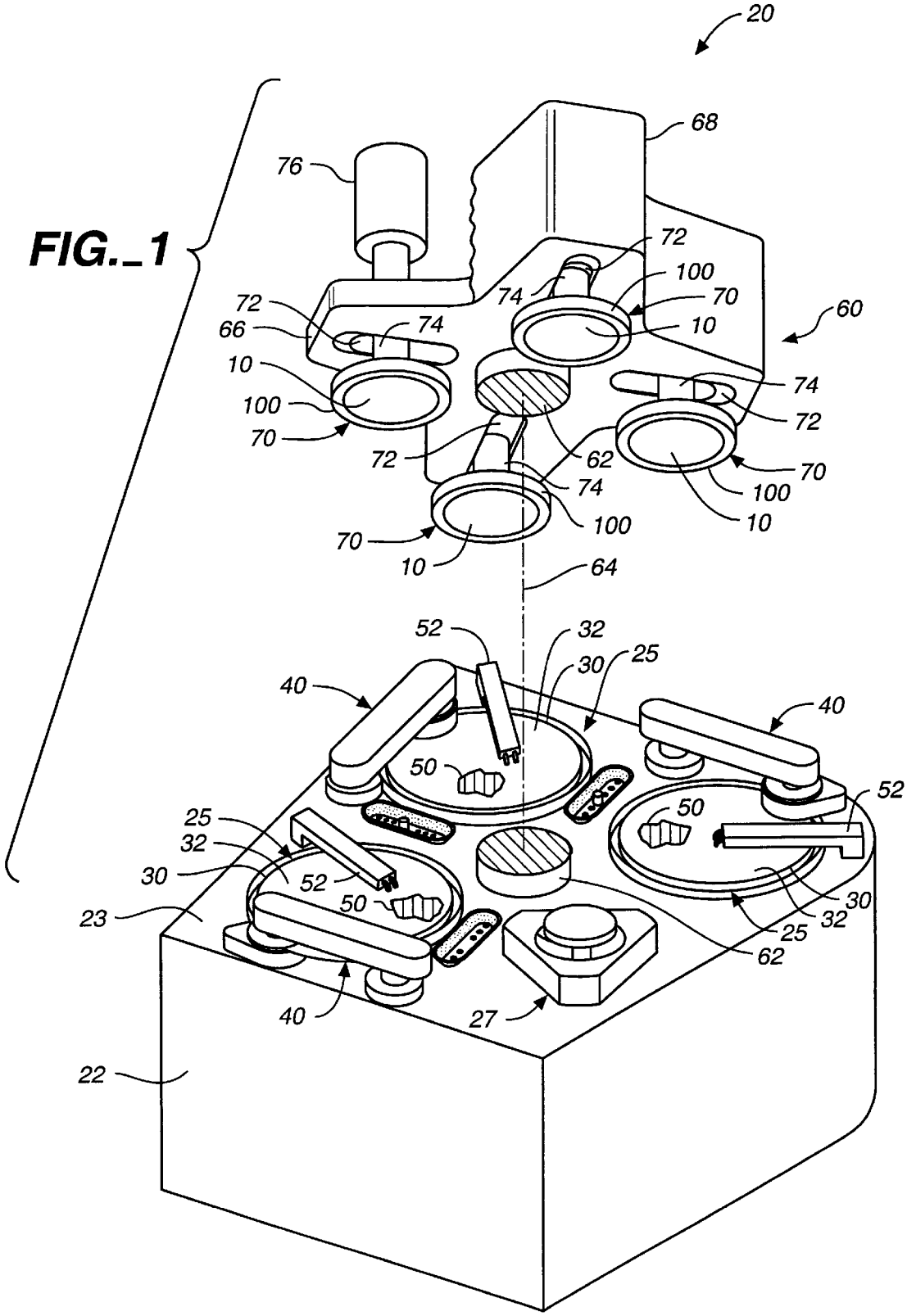
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a lower machine base 22 with a table top 23 mounted thereon and a removable upper outer cover (not shown). Table top 23 supports a series of polishing stations 25, and a transfer station 27 for loading and unloading the substrates. The transfer station may form a generally square arrangement with the three polishing stations.

Each polishing station includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70 mounted on carousel support plate 66 at equal angular intervals about carousel axis 64. Three of the carrier head systems receive and hold substrates and polish them by pressing them against the polishing pads of polishing stations 25. One of the carrier head systems receives a substrate from and delivers the substrate to transfer station 27. The carousel motor may orbit the carrier head systems, and the substrates attached thereto, about carousel axis 64 between the polishing stations and the transfer station.

Each carrier head system includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier heads.

During actual polishing, three of the carrier heads are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
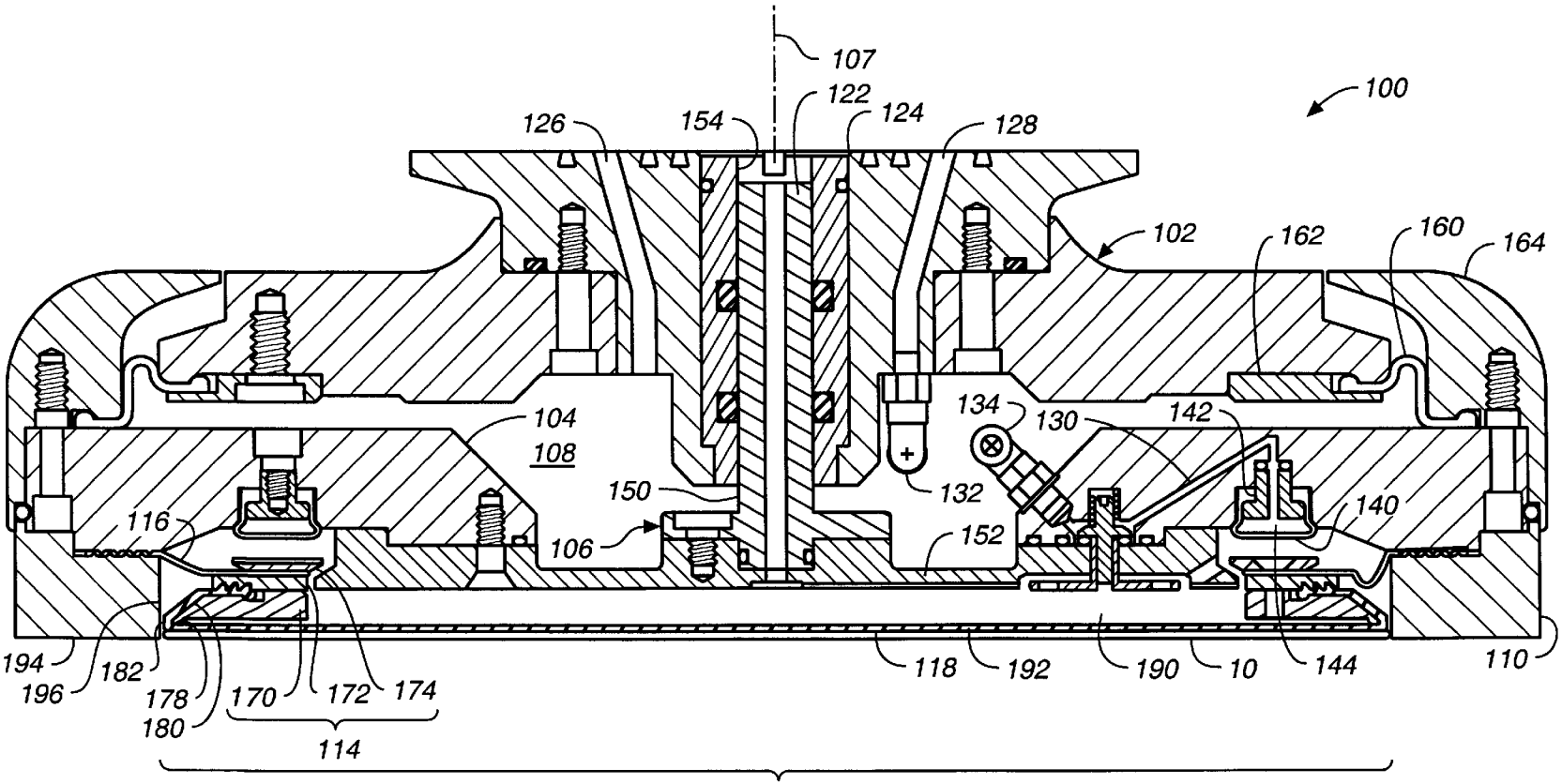
FIG. 2 is a schematic cross-sectional view of a carrier head according to the present invention.
Figure 3:
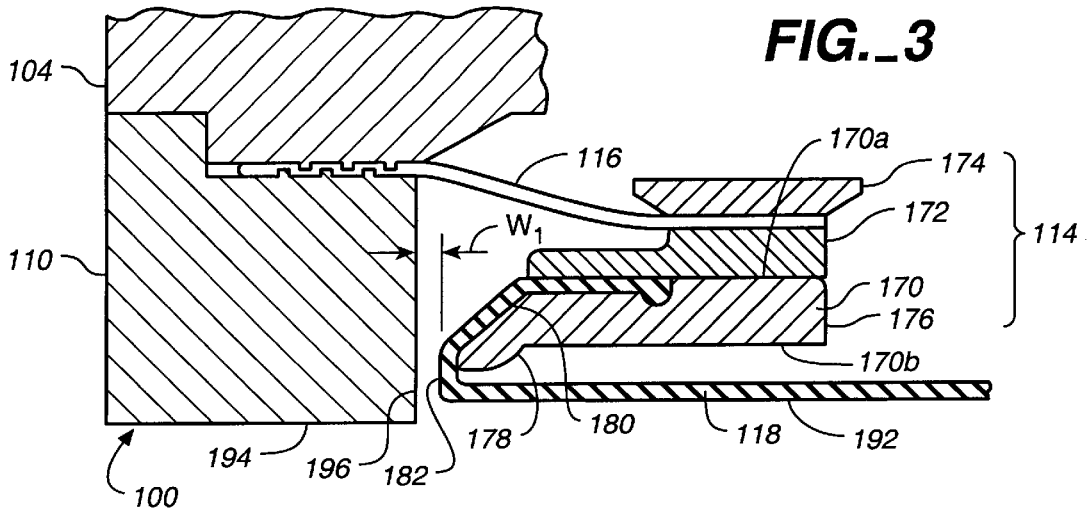
FIG. 3 is an enlarged view of the carrier head of FIG. 2 showing a tapered support structure.

Referring to FIGS. 2 and 3, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is hereby incorporated by reference.

Housing 102 can be connected to drive shaft 74 to rotate therewith during polishing about an axis of rotation 107 which is substantially perpendicular to the surface of the polishing pad during polishing. Loading chamber 108 is located between housing 102 and base 104 to apply a load, i.e., a downward pressure, to base 104. The vertical position of base 104 relative to polishing pad 32 is also controlled by loading chamber 108.

Substrate backing assembly 112 includes a support structure 114, a flexure diaphragm 116 connecting support structure 114 to base 104, and a flexible member or membrane 118 connected to support structure 114. Flexible membrane 118 extends below support structure 114 to provide a mounting surface 192 for the substrate. The sealed volume between flexible membrane 118, support structure 114, flexure diaphragm 116, base 104, and gimbal mechanism 106 defines a pressurizable chamber 190. A first pump (not shown) may be fluidly connected to chamber 190 to control the pressure in the chamber and thus the downward force of the flexible membrane on the substrate.

Housing 102 may be generally circular in shape to correspond to the circular configuration of the substrate to be polished. A cylindrical bushing 122 may fit into a vertical bore 124 through the housing, and two passages 126 and 128 may extend through the housing for pneumatic control of the carrier head.

Base 104 is a generally ring-shaped body formed of a rigid material and located beneath housing 102. A passage 130 may extend through the base, and two fixtures 132 and 134 may provide attachment points to connect a flexible tube between housing 102 and base 104 to fluidly couple passage 128 to passage 130.

An elastic and flexible membrane 140 may be attached to the lower surface of base 104 by a clamp ring 142 to define a bladder 144. Clamp ring 142 may be secured to base 104 by screws or bolts (not shown). A second pump (not shown) may be connected to bladder 144 to direct a fluid, e.g., a gas, such as air, into or out of the bladder and thereby control a downward pressure on support structure 114.

Gimbal mechanism 106 permits base 104 to pivot with respect to housing 102 so that the base may remain substantially parallel with the surface of the polishing pad. Gimbal mechanism 106 includes a gimbal rod 150 which fits into a passage 154 through cylindrical bushing 122 and a flexure ring 152 which is secured to base 104. Gimbal rod 150 may slide vertically along passage 154 to provide vertical motion of base 104, but it prevents any lateral motion of base 104 with respect to housing 102.

An inner edge of a ring-shaped rolling diaphragm 160 is clamped to housing 102 by an inner clamp ring 162, and an outer edge of rolling diaphragm 160 is clamped to base 104 by an outer clamp ring 164. Thus, rolling diaphragm 160 seals the space between housing 102 and base 104 to define loading chamber 108. A third pump (not shown) may be fluidly connected to loading chamber 108 to control the pressure in the loading chamber and the load applied to base 104.

Support structure 114 of substrate backing assembly 112 includes a support ring 170, an annular lower clamp 172, and an annular upper clamp 174. Support ring 170 may be a generally annular rigid member having a central aperture 176. Alternately, support ring 170 could be replaced by a disk-shaped support plate having a plurality of apertures therethrough. In addition, support ring 170 may have a downwardly-projecting lip 178 at its outer edge.

An outer surface 180 of support ring 170 may be angled or tapered. For example, the radius of support ring 170 at outer surface 180 may be smaller near the top surface 170*a* of the support ring than near its bottom surface 170*b*. Thus, assuming the inner surface 176 of the support ring is generally vertical, support ring 170 is wider at its bottom than at its the top. The sloped section of outer surface 180 may have an off-vertical angle between about 5° and 45°. The outer surface 180 also includes a generally rounded or vertical portion 182 at its lower edge. The tapered outer surface 180 reduces the surface contact area between flexible membrane 118 and retaining ring 110, preventing binding therebetween. The inner surface of retaining ring 110 may be separated from flexible membrane 118 by a gap having a width $W_1$ of about 0.2 to 0.5 mm, e.g., about 0.3 mm. Thus, flexible membrane 118 fits snugly in the recess defined by retaining ring 110, but is free to move vertically without binding.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between lower clamp 172 and upper clamp 174. Flexure diaphragm 116 is flexible and elastic, although it could be rigid in the radial and tangential directions. Flexure diaphragm 116 may formed of rubber, such as neoprene, an elastomeric-coated fabric, such as NYLON™ or NOMEX™, plastic, or a composite material, such as fiberglass.

Flexible membrane 118 is a generally circular sheet formed of a flexible and elastic material, such as chloroprene or ethylene propylene rubber. A portion of flexible membrane 118 extends around the edges of support ring 170 to be clamped between the support ring and lower clamp 172.

Retaining ring 110 may be a generally annular ring secured at the outer edge of base 104, e.g., by bolts (not shown). When fluid is pumped into loading chamber 108 and base 104 is pushed downwardly, retaining ring 110 is also pushed downwardly to apply a load to polishing pad 32. The bottom surface 194 of retaining ring 110 may be substantially flat, or it may have a plurality of channels to facilitate transport of slurry from outside the retaining ring to the substrate. An inner surface 196 of retaining ring 110 engages the substrate to prevent it from escaping from beneath the carrier head.

In operation, fluid is pumped into chamber 190 to control the downward pressure applied to the substrate by flexible membrane 118. When polishing is completed, fluid is pumped out of chamber 190 to vacuum chuck the substrate to flexible membrane 118. Then loading chamber 108 is evacuated to lift base 104 and backing structure 112.

Due to the limited surface contact area between the flexible membrane and the retaining ring, the flexible membrane is free to expand or contract without binding to the retaining ring. This permits the entire mounting surface of the flexible membrane to move upwardly and downwardly, thereby improving polishing uniformity.

Figure 4:
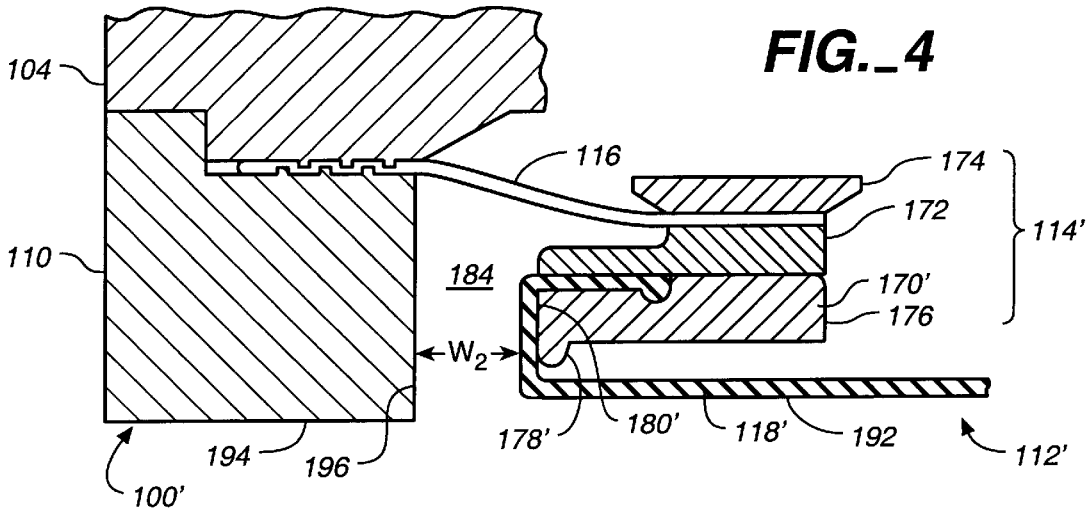
FIG. 4 is a cross-sectional view of a carrier head in which there is a relatively large gap between the flexible membrane and the retaining ring.

Referring to FIG. 4, a carrier head 100' may include a relatively large gap, e.g., having a width $W_2$ of about 0.5 to 2.0 mm, e.g., about 1.25 mm, between inner surface 194' of retaining ring 110' and flexible membrane 118'. An advantage of this implementation is that the gap prevents contact between a cylindrical outer surface 180' of support ring 170' and the inner surface of retaining ring 110.

Figure 5:
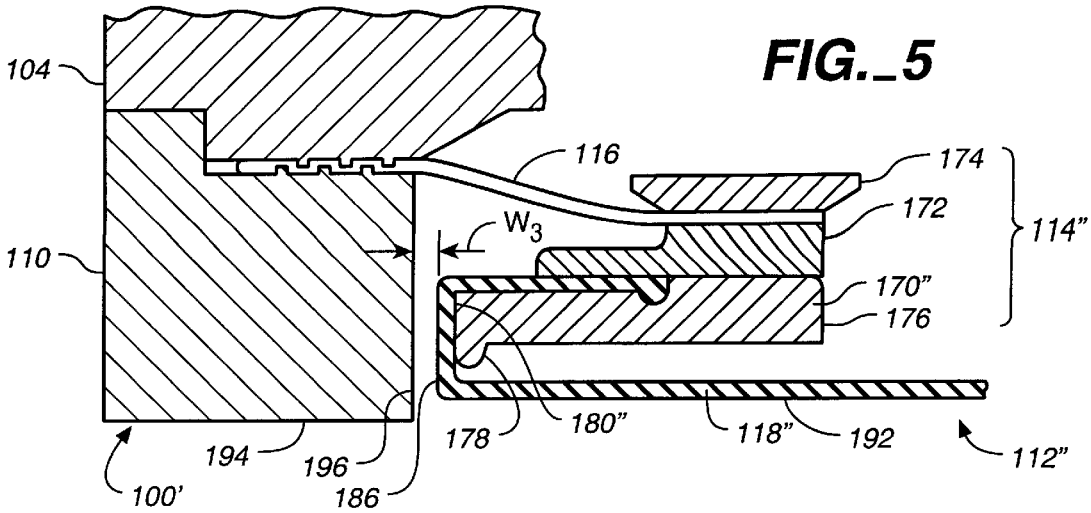
FIG. 5 is a cross-sectional view of a carrier head in which the flexible membrane includes a reinforced edge portion.

Referring to FIG. 5, a carrier head 100" may include a flexible membrane 118" with a reinforced sidewall portion 186 that extends around the cylindrical outer surface 182" of support ring 170". The sidewall portion 186 of flexible membrane 118" may be more rigid than the remainder of the flexible membrane. Specifically, flexible membrane 118" may be made a rubber such as chloroprene or ethylene propylene, and reinforced at sidewall portion 186 with strands of interwoven fibers, such as cloth fibers or polymer fibers. Alternately, a rigid ring of metal or plastic may be molded into the sidewall portion. The reinforced sidewall portion 186 reduces the outward expansion of flexible membrane 118" when chamber 190 is pressurized. This makes it less likely that the flexible membrane will contact the retaining ring, thereby reducing binding. The sidewall portion 186 of flexible membrane 118" may be separated from inner surface 194 of retaining ring 110 by a gap having a width $W_3$ between about 0.2 and 0.5 mm.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a base;

a flexible membrane extending beneath the base to provide a mounting surface for a substrate;

a retaining ring surrounding the mounting surface, an interior surface of the retaining ring defining a pocket;

a rigid support structure located in the pocket, a portion of the flexible membrane extending around a radial outer surface of the support structure, wherein the outer surface of the support structure is tapered so as to reduce binding between the flexible membrane and the retaining ring.

2. The carrier head of claim 1, wherein the support structure includes a support ring and a clamp, and the edge portion of the flexible membrane is secured between the clamp and the support ring.

3. The carrier head of claim 1, wherein a radius of the outer surface of the support structure is greater at a bottom thereof is greater than a radius of the outer surface of the support structure at a top thereof.

4. The carrier head of claim 1, wherein the outer surface of the support structure includes a sloped section.

5. The carrier head of claim 4, wherein the outer surface further includes a substantially vertical section.

6. The carrier head of claim 4, wherein the sloped section has an off-vertical angle between about 5° and 45°.

7. A carrier head for a chemical mechanical polishing apparatus, comprising:

a base;

a support structure movably connected to the base;

a flexible membrane connected to the support structure and extending beneath the base to provide a mounting surface for a substrate;

a retaining ring supporting the mounting surface, an inner surface of the retaining ring defining a pocket;

a rigid support structure located in the pocket, a portion of the flexible membrane extending around an outer surface of the support structure, wherein the outer surface of the support structure is tapered to limit contact between the edge portion of the flexible membrane and an inner surface of the retaining ring so as to reduce binding therebetween.

8. A carrier head for a chemical mechanical polishing apparatus, comprising:

a base;

a flexible membrane extending beneath the base to provide a mounting surface for a substrate;

a retaining ring surrounding the mounting surface, an interior surface of the retaining ring defining a pocket;

a rigid support structure located in the pocket, an edge portion of the flexible membrane extending around and in contact with a radially outer surface of a support structure, wherein a gap between the outer surface of the support structure and the inner surface of the retaining ring is sufficiently wide so as to reduce binding between the flexible membrane and the retaining ring.

9. The carrier head of claim 8, wherein the width of the gap is between about 0.5 and 2.0 mm.

10. The carrier head of claim 8, wherein the width of the gap is about 1.25 mm.

11. A carrier head for a chemical mechanical polishing apparatus, comprising:

a base;

a flexible membrane extending beneath the base to provide a mounting surface for a substrate, an edge portion of the flexible membrane extending around an outer surface of a support structure; and a retaining ring surrounding the mounting surface, wherein a first material in a sidewall portion of the flexible membrane is more rigid than a second material in the lower surface of the flexible membrane so that the sidewall portion is more rigid than the lower surface in order to reduce binding between the retaining ring and the flexible membrane.

12. The carrier head of claim 11, wherein the sidewall portion of the flexible membrane includes the second material and is reinforced with the first material.

13. The carrier head of claim 12, wherein the flexible membrane is formed substantially of rubber.

14. The carrier head of claim 13, wherein the sidewall portion of the flexible membrane is reinforced with a material selected from cloth, metal and plastic.

15. The carrier head of claim 13, wherein reinforcing fibers are molded into the sidewall portion of the flexible membrane.

16. The carrier head of claim 13, wherein a rigid ring is molded into the sidewall portion of the flexible membrane.

17. A carrier head for a chemical mechanical polishing apparatus, comprising:

a base;

a flexible membrane extending beneath the base to provide a mounting surface for a substrate, an edge portion of the flexible membrane extending around an outer surface of a support structure;

a retaining ring surrounding the mounting surface; and means for reducing binding between the flexible membrane and the retaining ring.

18. The carrier head of claim 1, wherein the flexible membrane provides a pressurizable chamber, and the support structure is located in chamber.

19. The carrier head of claim 1, wherein the support structure is located between the flexible membrane and the base.

20. The carrier head of claim 1, wherein the membrane contacts the outer surface of the support structure.

21. A carrier head for a chemical mechanical polishing apparatus, comprising:

a base;

a flexible membrane extending beneath the base to provide a mounting surface for a substrate;

a retaining ring surrounding the mounting surface, an interior surface of the retaining ring defining a pocket;

a rigid support structure located in the pocket, a portion of the flexible membrane contacting and extending around a tapered radial outer surface of the support structure.

22. A carrier head for a chemical mechanical polishing apparatus, comprising:

a base;

a flexible membrane extending beneath the base to provide a mounting surface for a substrate, an edge portion of the flexible membrane extending around an outer surface of a support structure; and a retaining ring surrounding the mounting surface, wherein a first material in a sidewall portion of the flexible membrane is more rigid than a second material in the lower surface of the flexible membrane so that the sidewall portion is more rigid than the lower surface.

* * * * *